US007846629B2

(12) United States Patent
Yanus et al.

(10) Patent No.: US 7,846,629 B2
(45) Date of Patent: Dec. 7, 2010

(54) IMAGING MEMBER

(75) Inventors: John F. Yanus, Webster, NY (US); Kenny-Tuan Tran Dinh, Webster, NY (US); Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1064 days.

(21) Appl. No.: 11/557,518

(22) Filed: Nov. 8, 2006

(65) Prior Publication Data

US 2008/0107978 A1 May 8, 2008

(51) Int. Cl.
*G03G 5/043* (2006.01)

(52) U.S. Cl. ..... 430/66; 430/56

(58) Field of Classification Search ..... 430/56, 430/66

See application file for complete search history.

(56) References Cited

U.S. PATENT DOCUMENTS

| | | | | |
|---|---|---|---|---|
| 3,121,006 | A | 2/1964 | Middleton et al. | |
| 5,484,867 | A * | 1/1996 | Lichtenhan et al. | 528/9 |
| 5,709,974 | A * | 1/1998 | Yuh et al. | 430/123.42 |
| 2006/0105264 | A1 * | 5/2006 | Dinh et al. | 430/132 |
| 2006/0177748 | A1 * | 8/2006 | Wu et al. | 430/58.2 |

* cited by examiner

*Primary Examiner*—Mark F Huff
*Assistant Examiner*—Peter L Vajda
(74) *Attorney, Agent, or Firm*—Fay Sharpe LLP

(57) ABSTRACT

An imaging member has a crosslinked overcoat layer. The overcoat layer is formed from an overcoat solution comprising a trisilanol polyhedral oligomeric polysilsesquioxane; two crosslinking agents; a hole transport molecule; an acid catalyst; and an alcohol solvent. The overcoat layer provides excellent wear resistance at a low cost.

20 Claims, 1 Drawing Sheet

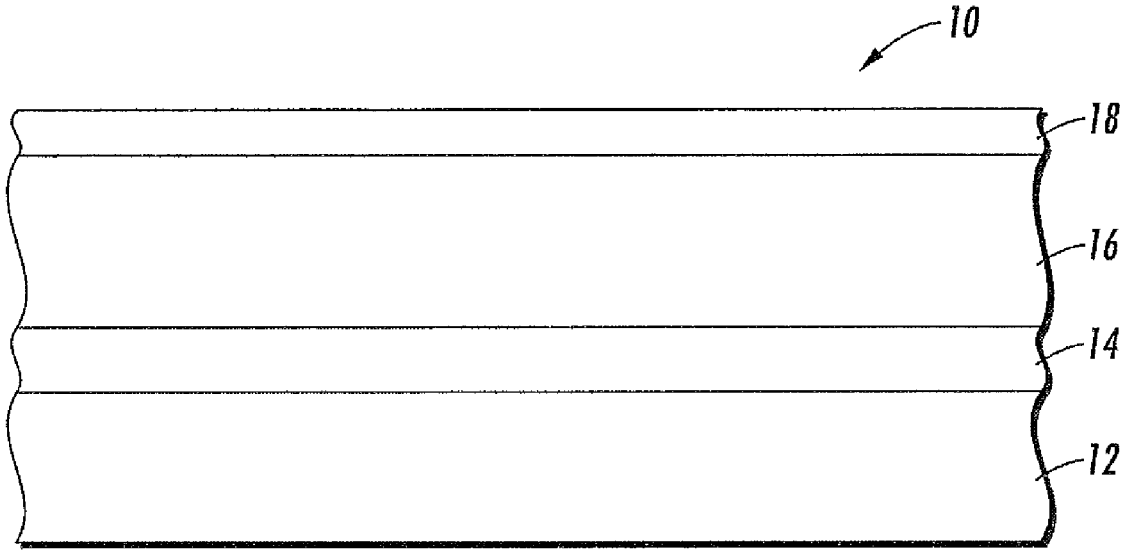
10
18
16
14
12

IMAGING MEMBER

BACKGROUND

The present disclosure relates, in various embodiments, to imaging members comprising an overcoat layer and methods of forming such imaging members. The overcoat layer in accordance with the present disclosure is a crosslinked polymer matrix comprising a silanol.

In the art of electrophotography, an electrophotographic imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper. This imaging process may be repeated many times with reusable photosensitive members.

Electrophotographic imaging members are usually multilayered photoreceptors that comprise a substrate support, an electrically conductive layer, an optional hole blocking layer, an optional adhesive layer, a charge generating layer, a charge transport layer, and an optional protective or overcoat layer(s). The imaging members can take several forms, including flexible belts, rigid drums, etc. For most multilayered flexible photoreceptor belts, an anti-curl layer is usually employed on the back side of the substrate support, opposite to the side carrying the electrically active layers, to achieve the desired photoreceptor flatness.

Imaging members are generally exposed to repetitive electrophotographic cycling which subjects exposed layers of imaging devices to abrasion, chemical attack, heat and multiple exposures to light. This repetitive cycling leads to a gradual deterioration in the mechanical and electrical characteristics of the exposed layers. For example, repetitive cycling has adverse effects on exposed portions of the imaging member. Attempts have been made to overcome these problems. However, the solution of one problem often leads to additional problems.

In electrophotographic imaging devices, the charge transport layer may comprise a high loading of a charge transport compound dispersed in an appropriate binder. The charge transport compound may be present in an amount greater than about 35% based on the weight of the charge transport layer. For example, the charge transport layer may comprise 50% of a charge transport compound in about 50% binder. A high loading of charge transport compound appears to drive the chemical potential of the charge transport layer to a point near the metastable state, which is a condition that induces crystallization, leaching and stress cracking when placed in contact with a chemically interactive solvent or ink. Photoreceptor functionality may be completely destroyed when a charge transport layer having a high loading of a charge transport molecule is contacted with liquid ink. It is thus desirable to eliminate charge transport molecule crystallization, leaching and solvent-stress charge transport layer cracking.

Cracks developed in the charge transport layer during cycling are a frequent phenomenon and most problematic because they can manifest themselves as print-out defects which adversely affect copy quality. Charge transport layer cracking has a serious impact on the versatility of a photoreceptor and reduces its practical value for automatic electrophotographic copiers, duplicators and printers.

Another problem encountered with electrophotographic imaging members is corona species induced deletion in print due to degradation of the charge transport molecules by chemical reaction with corona species. During electrophotographic charging, corona species are generated. Corona species include, for example ozone, nitrogen oxides, acids and the like.

Other problems affecting the performance of the imaging member include lateral charge migration (LCM) and stress cracking in the photoreceptor. The concentration of charge transport molecules in the charge transport layer is a known factor affecting the degree of lateral charge migration. In particular, higher concentrations of charge transport molecules near the surface of the charge transport layer tend to result in a higher degree of lateral charge migration and more stress cracks.

One approach to achieving longer photoreceptor drum life is to form a protective overcoat on the imaging surface, e.g. the charge transporting layer of a photoreceptor. This overcoat layer must satisfy many requirements, including transporting holes, resisting image deletion, resisting wear, and avoidance of perturbation of underlying layers during coating. The overcoat layer should also have low residual potential and low surface energy. Low surface energy allows for quantitative toner image transfer and ease of cleaning.

Siloxanes are well known for imparting low surface energy properties to coatings; they exhibit excellent release and cleaning attributes. Unfortunately, they are mechanically weak materials and cannot withstand even minor abrasive wear.

There is a need for an overcoat layer that will reduce lateral charge migration, deletion, cracks, and has low residual potential while still providing an imaging member that exhibits satisfactory electrical properties.

BRIEF DESCRIPTION

Disclosed herein, in various embodiments, is a photoconductive imaging member having an overcoat layer and methods of producing such an imaging member. The overcoat layer is formed from an overcoat solution comprising a silanol, at least one crosslinking agent, and an acid catalyst. The solution may further comprise a hole transport molecule. The solvent may be an alcohol.

In further embodiments, the silanol is a trisilanol. In further embodiments, the silanol is a polyhedral oligomeric polysilsesquioxane (POSS).

In further embodiments, the overcoat solution comprises two crosslinking agents. The first crosslinking agent has multiple hydroxyl or carboxyl groups for forming crosslinks. The second crosslinking agent is highly alkylated. In specific embodiments, the first crosslinking agent is a polyol or polyester and the second crosslinking agent is a methylated or butylated melamine-formaldehyde resin.

The overcoat layer of the present disclosure forms a crosslinked polymer matrix incorporating the crosslinking agent(s) and silanol. The crosslinked polymer matrix may further incorporate the hole transport molecule when used.

Also included is the imaging member and overcoat layer produced by the methods and processes of utilizing the same for imaging.

The present disclosure, in further embodiments thereof, also includes an imaging member comprising a substrate; a charge generating layer; a charge transport layer comprising a charge transport molecule; and an overcoat layer. The overcoat layer is formed from an overcoat solution as described above. A method of imaging employing this imaging member is also included in the present disclosure.

These and other non-limiting features or characteristics of the disclosure are more particularly disclosed below.

BRIEF DESCRIPTION OF THE DRAWINGS

The following is a brief description of the drawings, which are presented for the purposes of illustrating the disclosure set forth herein and not for the purposes of limiting the same.

FIG. 1 is a schematic cross sectional view of a photoconductive imaging member in accordance with the present disclosure.

DETAILED DESCRIPTION

The present disclosure relates to a photoconductive imaging member having a charge transport layer and an overcoat layer. Also included within the scope of the present disclosure are methods of imaging and printing with the photoresponsive devices illustrated herein. These methods generally involve the formation of an electrostatic latent image on the imaging member, followed by developing the image with a toner composition, subsequently transferring the image to a suitable substrate, such as paper, and permanently affixing the image thereto.

A more complete understanding of the processes and apparatuses disclosed herein can be obtained by reference to the accompanying drawings. These Figures are merely schematic representations based on convenience and the ease of demonstrating the present development, and are, therefore, not intended to indicate relative size and dimensions of the imaging devices or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to component of like function.

With reference to FIG. 1, a photoconductive imaging member in accordance with the present disclosure is shown. Photoconductive imaging member 10 comprises a substrate 12, a charge generating or photogenerating layer 14, a charge transport layer 16, and an overcoat layer 18. Overcoat layer 18 is formed from an overcoat solution in accordance with the present disclosure.

The substrate may be opaque or substantially transparent and may comprise any suitable material having the required mechanical properties. Accordingly, the substrate may comprise a layer of an electrically non-conductive or conductive material such as an inorganic or an organic composition. Various resins may be employed as non-conductive materials including polyesters, polycarbonates, polyamides, polyurethanes, and the like, which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength and desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness, e.g., less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be from about 20 angstroms to about 750 angstroms, and more preferably from about 100 angstroms to about 200 angstroms for an optimum combination of electrical conductivity, flexibility, and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer may be utilized and such adhesive layer materials are well known in the art. Typical adhesive layer materials include, for example, polyesters, polyurethanes, and the like. Satisfactory results may be achieved with adhesive layer thickness from about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying, and the like.

At least one electrophotographic imaging layer is formed on the adhesive layer, blocking layer, or substrate. The electrophotographic imaging layer may be a single layer that performs both charge generating and charge transport functions, as is well known in the art, or it may comprise multiple layers such as a charge generator layer and charge transport layer. Charge generator (also referred to as photogenerating) layers may comprise amorphous films of selenium and alloys of selenium and arsenic, tellurium, germanium and the like, hydrogenated amorphous silicon and compounds of silicon and germanium, carbon, oxygen, nitrogen, and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakisazos; and the like dispersed in a film forming polymeric binder and fabricated by solvent coating techniques. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene bisimide pigments; indigo pigments such as indigo, thioindigo, and the like; bisbenzoimidazole pigments such as Indofast Orange toner, and the like; phthalocyanine pigments such as titanyl phthalocyanine, aluminochlorophthalocyanine, hydroxygalliumphthalocyanine, and the like; quinacridone pigments; or azulene compounds. Suitable inorganic photoconductive charge generating materials include for example cadmium sulfide, cadmium sulfoselenide, cadmium selenide, crystalline and amorphous selenium, lead oxide and other chalcogenides. Alloys of selenium are encompassed by embodiments of the disclosure and include for instance selenium-arsenic, selenium-tellurium-arsenic, and selenium-tellurium.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal-free phthalocyanine. The phthalocyanines exist in many crystal forms, which have a strong influence on photo-generation.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrenealkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder. In embodiments, preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removing the solvent of a solvent coated layer may be effected by any suitable conventional technique such as oven drying, infrared radiation drying, air drying and the like.

In fabricating a photosensitive imaging member, a charge generating material (CGM) or pigment, herein the terms "pigment" and "charge generating material" are used interchangeably, and a charge transport material (CTM) may be deposited onto the substrate surface either in a laminate type configuration where the CGM and CTM are in different layers or in a single layer configuration where the CGM and CTM are in the same layer along with a binder resin. A photoreceptor can be prepared by applying over the electrically conductive layer the charge generation layers and a charge transport layer. In embodiments, the charge generating layer and the charge transport layer may be applied in any order.

In embodiments, the charge generating layer adjacent to the charge transporting layer is partially trapping to charge generated in the other charge generating layer(s) which are passing through this layer to the charge transporting layer. Normally, the above photoexcited charges are holes so the generation layer adjacent to the transport layer must be partially trapping to holes transiting through it, but if the transport layer transports electrons it would be electron trapping. This functionality can be in the pigment itself, that is, the pigment may be a good electron transporter but a poor hole transporter. Such pigments are sometimes referred to as extrinsic pigments because they require the presence of hole transport, i.e., electron donor, molecules. Examples of extrinsic electron transporting pigments are perylene and azo pigments and theirs. The degree of hole trapping can be controlled by introducing hole transport molecules either directly or by diffusion from the charge transport layer. Examples of charge transport materials are listed below. Alternatively or in combination, additives can be used to increase the charge trapping. Thus in case of ambipolar, also referred to as intrinsic, pigments such as phthalocyanines, trapping additives in combination with charge transport molecules can be added. Suitable additives are other charge transport materials whose energy levels are 0.2 eV different from the primary charge transport molecule.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as arylamines; carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(-vinyltetraphene); poly(vinyltetracene) and poly(vinylperylene).

Aryl amines selected as the hole transporting component include molecules of the following formula

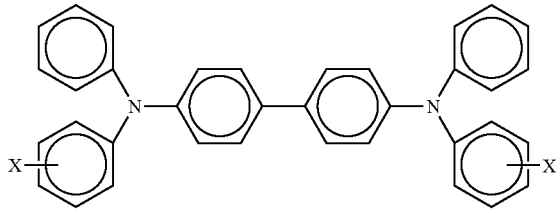

preferably dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine (TPD) wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone, biphenylquinones and phenylquinones.

Any suitable inactive resin binder with the desired mechanical properties may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000. However, the resin binder of the charge transport layer should not be soluble in the solvent used to apply the overcoat layer of the present disclosure.

Any suitable technique may be utilized to apply the charge transport layer and the charge generating layers. Typical application techniques include spraying, dip coating, roll coating, wire wound rod coating, vacuum coating, and the like. Drying of the deposited coating may be effected by any suitable conventional technique such as oven drying, infrared radiation drying, air drying and the like. Generally, the thickness of each charge generating layer ranges from about 0.1 micrometer to about 3 micrometers and the thickness of the transport layer is from about 5 micrometers to about 100 micrometers, but thicknesses outside these ranges can also be used. The thickness of the charge generating layer adjacent to the charge transport layer is selected so that the required fraction of the charge is trapped resulting in the desired voltage. The desired thickness is then governed by the fraction of charge transiting the charge generating layer adjacent to the charge transport layer. In general, the ratio of the thickness of the charge transport layer to the charge generating layer is preferably maintained from about 2:1 to 200:1 and in some instances as great as 400:1.

The overcoat layer 18 is formed from an overcoat solution comprising a silanol, at least one crosslinking agent, and an acid catalyst. The solution may further comprise a hole transport molecule. In specific embodiments, the silanol is a trisilanol. In more specific embodiments, the silanol is a polyhedral oligomeric polysilsesquioxane (POSS). The solvent may be an alcohol.

The silanol, in general, is a silicon atom with a hydroxyl group attached to it. Several silanols may be suitable. One example of a suitable silanol has the following formula:

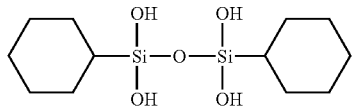

Another example of a suitable silanol has the formula $(R_1)_3SiOH$, wherein $R_1$ is selected from alkyl, alkoxy, alkylsilyl, and aryl. It is contemplated that $R_1$ may be linear or branched and may further be substituted, especially if $R_1$ is aryl. In further specific embodiments, $R_1$ has one of the following formulas:

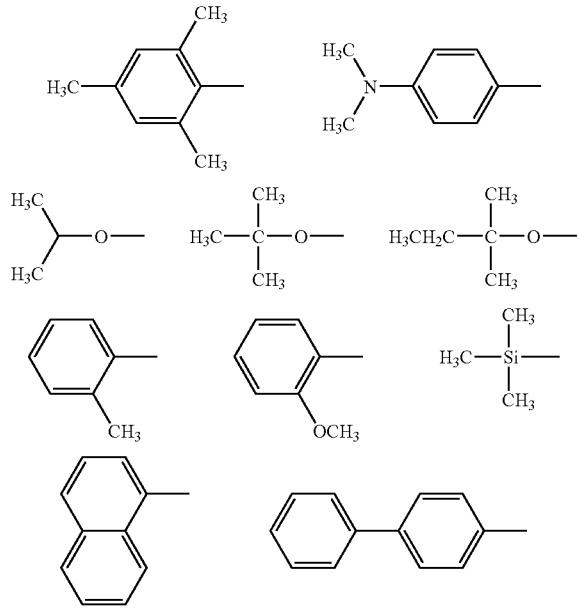

These silanols include dimethyl(thien-2-yl)silanol, tris(isopropoxy)silanol, tris(tert-butoxy)silanol, tris(tert-pentoxy)silanol, tris(o-tolyl)silanol, tris(1-naphthyl)silanol, tris(2,4,6-trimethylphenyl)silanol, tris(2-methoxyphenyl)silanol, tris(4-(dimethylamino)phenyl)silanol, tris(4-biphenylyl)silanol, tris(trimethylsilyl)silanol, and dicyclohexyltetrasilanol ($C_{12}H_{26}O_5Si_2$). Of course, mixtures of these silanols are also contemplated.

In specific embodiments, the silanol is a polyhedral oligomeric polysilsesquioxane (POSS). A POSS is a form of an incompletely condensed silsesquioxane. It resembles a cube with one corner removed and possesses both structural and electronic similarities to hydroxylated silica surface sites. The POSS of the present disclosure may have the following formulas:

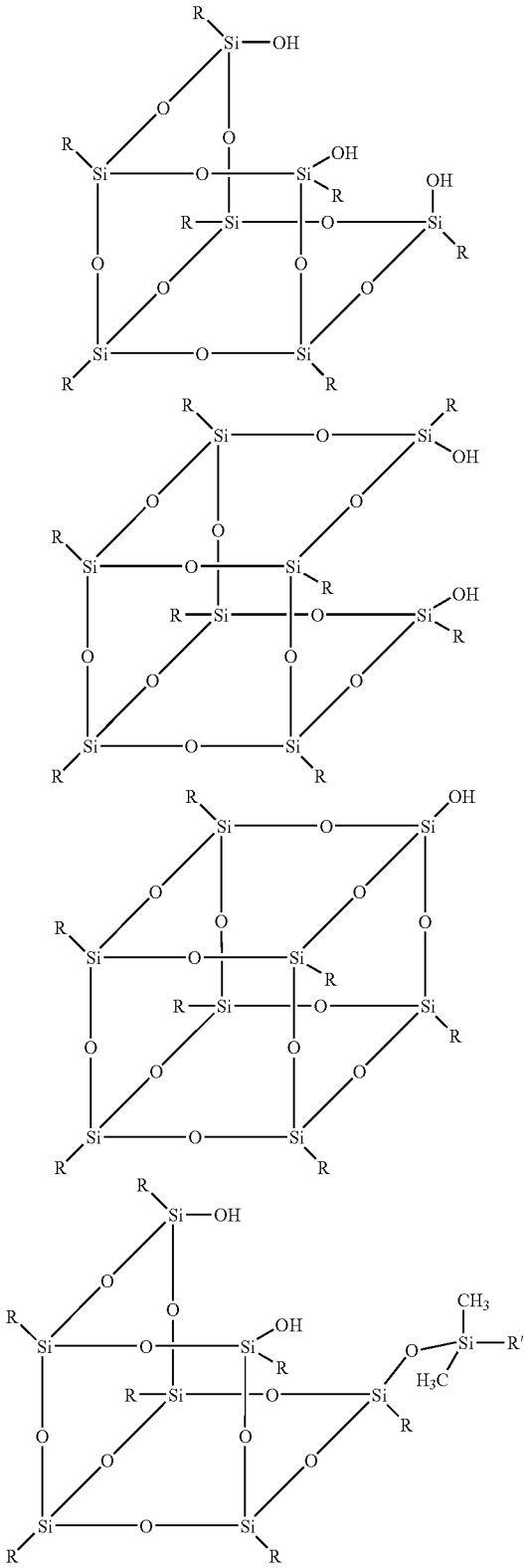

wherein R and R' are independently selected from alkyl, cycloalkyl, phenyl, aryl, alkoxy, or halogen. When R or R' is alkyl, phenyl, aryl, or alkoxy, it may be substituted as well-.Linear and branched side groups are contemplated as well.

Specific POSS silanols suitable for use include isobutyl-POSS cyclohexenyldimethylsilyldisilanol or isobutyl-polyhedral oligomeric silsesquioxane cyclohexenyldimethylsilyldisilanol ($C_{38}H_{84}O_{12}Si_8$), cyclopentyl-POSS dimethylphenyldisilanol ($C_{43}H_{76}O_{12}Si_8$), cyclohexyl-POSS dimethylvinyidisilanol ($C_{46}H_{88}O_{12}Si_8$), cyclopentyl-POSS dimethylvinyldisilanol ($C_{39}H_{74}O_{12}Si_8$), isobutyl-POSS dimethylvinyldisilanol ($C_{32}H_{74}O_{12}Si_8$), cyclopentyl-POSS disilanol ($C_{40}H_{74}O_{13}Si_8$), isobutyl-POSS disilanol ($C_{32}H_{74}O_{13}Si_8$), isobutyl-POSS epoxycyclohexyldisilanol ($C_{38}H_{84}O_{13}Si_8$), cyclopentyl-POSS fluoro(3)disilanol ($C_{40}H_{75}F_3O_{12}Si_8$), cyclopentyl-POSS fluoro(13)disilanol ($C_{45}H_{75}F_{13}O_{12}Si_8$), isobutyl-POSS fluoro(13)disilanol ($C_{38}H_{75}F_{13}O_{12}Si_8$), cyclohexyl-POSS methacryldisilanol ($C_{51}H_{96}O_{14}Si_8$), cyclopentyl-POSS methacryldisilanol ($C_{44}H_{82}O_{14}Si_8$), isobutyl-POSS methacryldisilanol ($C_{37}H_{82}O_{14}Si_8$), cyclohexyl-POSS monosilanol ($C_{42}H_{78}O_{13}Si_8$), cyclopentyl-POSS monosilanol (Schwabinol, $C_{35}H_{64}O_{13}Si_8$), isobutyl-POSS monosilanol ($C_{28}H_{64}O_{13}Si_8$), cyclohexyl-POSS norbornenylethyldisilanol ($C_{53}H_{98}O_{12}Si_8$), cyclopentyl-POSS norbornenylethyldisilanol ($C_{46}H_{84}O_{12}Si_8$), isobutyl-POSS norbornenylethyldisilanol ($C_{39}H_{84}O_{12}Si_8$), cyclohexyl-POSS TMS disilanol ($C_{45}H_{88}O_{12}Si_8$), isobutyl-POSS TMS disilanol ($C_{31}H_{74}O_{12}Si_8$), cyclohexyl-POSS trisilanol ($C_{42}H_{80}O_{12}Si_7$), cyclopentyl-POSS trisilanol ($C_{35}H_{66}O_{12}Si_7$), isobutyl-POSS trisilanol ($C_{28}H_{66}O_{12}Si_7$), isooctyl-POSS trisilanol ($C_{56}H_{122}O_{12}Si_7$), phenyl-POSS trisilanol ($C_{42}H_{38}O_{12}Si_7$), and the like, all commercially available from Hybrid Plastics, Fountain Valley, Calif.

In specific embodiments, the POSS is trisilanol phenyl polyhedral oligomeric polysilsesquioxane (ph-POSS), wherein R is phenyl. ph-POSS has the following structure:

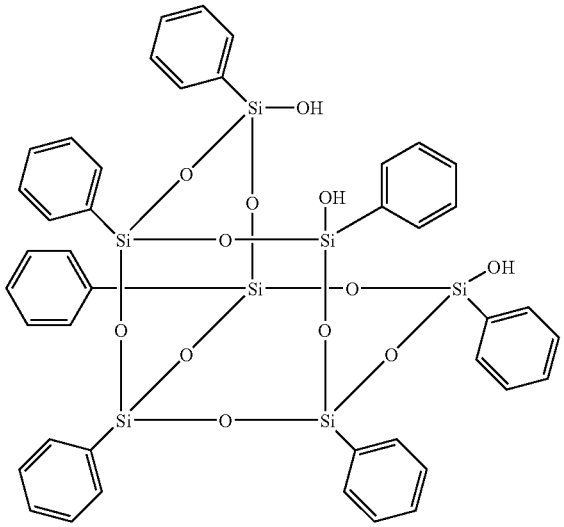

The POSS silanol can contain from about 7 to about 20 silicon atoms, or from about 7 to about 12 silicon atoms. The Mw of the POSS silanol is, for example, from about 700 to about 2,000, or from about 800 to about 1,300.

The silanol may be present in an amount of from about 0.01 to about 50 percent by weight of the dried overcoat layer. In further embodiments, the silanol may be present in an amount of from about 5 to about 20 percent by weight. The POSS silanol may also be present in an amount of from about 1 to about 10% weight percent, based on the weight of the dried overcoat layer. Adding ph-POSS to the overcoat layer has been found to reduce residual potential by ~50 volts while maintaining other critical performance attributes such as crack and scratch resistance and preventing LCM from occurring. Without being bound by theory, it appears the free —OH groups of the silanol provide additional crosslinking sites in the overcoat polymer matrix. It is also believed that the silanol hindered structures at the other three bonds attached to the silicon atom render them stable for extended time periods, such as from at least one week to over two years. The siloxane nature of ph-POSS also imparts low surface energy, which reduces toner filming.

The crosslinking agent(s) promotes the formation of crosslinks between the various components of the overcoat solution, especially the silanol and the hole transport molecule (when present). The crosslinking occurs after the overcoat solution has been applied to the charge transport layer, i.e. during drying. The crosslinking agent may be a polyhydroxy functional polymer, hydroxyl containing material with three or more hydroxyl groups per molecule, or a methylated and/or butylated melamine-formaldehyde resin. The crosslinking agent is present in an amount of from about 5 to about 60 weight percent, based on the weight of the dried overcoat layer.

In other embodiments, the overcoat comprises two crosslinking agents. The first crosslinking agent is a polyol or polyester having multiple hydroxyl or carboxyl sites (respectively) for crosslinking. The second crosslinking agent is a methylated and/or butylated melamine-formaldehyde resin having a high degree of alkylation.

The crosslinking agent can also be selected from the group of polymers. The crosslinking agent may be selected from the group consisting of polycarbonates, polystyrenes, polyamides, combinations thereof, and the like.

The overcoat layer can further comprise a hole transport molecule. The hole transport molecule aids in transporting holes across the overcoat layer and into the charge transport layer. The hole transport molecule becomes part of the crosslinked polymer matrix itself. The hole transport molecule should be soluble in alcohol. A highly suitable hole transport molecule is N,N'-diphenyl-N,N'-bis(3-hydroxyphenyl)-[1,1'-biphenyl]-4,4'-diamine, also known as DHTPD, which will polymerize due to the presence of the —OH groups. DHTPD is represented by the following formula:

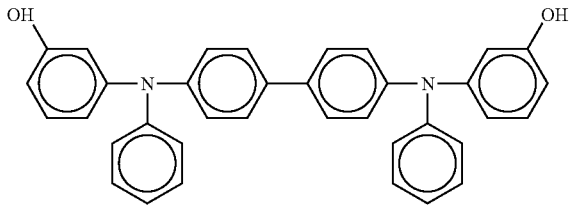

Other suitable hole transport molecules include terphenyl arylamines represented by:

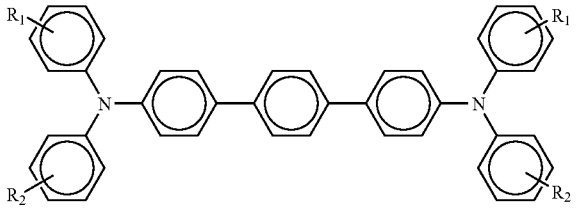

where $R_1$ and $R_2$ are independently selected from the group consisting of hydrogen, hydroxyl, alkyl having from 1 to about 12 carbon atoms, aralkyl having from about 6 to about 36 carbon atoms, and aryl having from about 6 to about 36 carbon atoms groups; wherein at least one of $R_1$ and $R_2$ is not hydrogen.

The dihydroxyarylamine compounds can be free of any direct conjugation between the hydroxyl groups and the nearest nitrogen atom through one or more aromatic rings. The expression "direct conjugation" refers for example, to the presence of a segment, having the formula $—(C{=}C)_n—C{=}C—$ in one or more aromatic rings directly between a hydroxyl group and the nearest nitrogen atom. Examples of direct conjugation between the hydroxyl groups and the nearest nitrogen atom through one or more aromatic rings include a compound containing a phenylene group having a hydroxyl group in the ortho or para position (or 2 or 4 position) on the phenylene group relative to a nitrogen atom attached to the phenylene group or a compound containing a polyphenylene group having a hydroxyl group in the ortho or para position on the terminal phenylene group relative to a nitrogen atom attached to an associated phenylene group. Examples of aralkyl groups include, for example, $—C_nH_{2n}$-phenyl groups where n is from about 1 to about 5 or from about 1 to about 10; examples of aryl groups include phenyl, naphthyl, biphenyl, and the like. In embodiments when $R_1$ is —OH and $R_2$ is n-butyl, the resultant compound is N,N'-bis[4-n-butylphenyl]-N,N'-bis[3-hydroxyphenyl]-terphenyl-diamine.

The hole transport is soluble in the solvent selected for the formation of the overcoat layer. The hole transport molecule can be present in an amount of from about 10 to about 60 weight percent, based on the weight of the dried overcoat layer.

The overcoat solution may also comprise an acid catalyst to accelerate the crosslinking process between the various components of the overcoat layer. Non-limiting examples of acid catalysts include: oxalic acid, maleic acid, carbollylic acid, ascorbic acid, malonic acid, succinic acid, tartaric acid, citric acid, p-toluenesulfonic acid, methanesulfonic acid, and the like and mixtures thereof.

The overcoat solution should be at an acidic pH in order to facilitate the crosslinking reaction. The pH of the overcoat solution should be below 3. Basic catalysts are not suitable for the overcoat layer because the chemistry is incorrect and they will not work in accelerating the crosslinking of the overcoat matrix.

The solvent of the overcoat solution is an alcohol in which all of the components of the overcoat layer are soluble. Suitable solvents for the overcoat solution include, but are not limited to, tert-butanol, sec-butanol, 2-propanol, 1-methoxy-2-propanol, and the like and mixtures thereof. Other suitable co-solvents that can be used in forming the overcoat layer include, but are not limited to, tetrahydrofuran, monochlorobenzene, and mixtures thereof. These co-solvents can be used as diluents for the above alcohol solvents or they can be omitted. However, in some embodiments, it may be of value to avoid the use of high boiling alcohol solvents since they may interfere with efficient cross-linking.

It will be readily ascertainable by a skilled artisan what solvents will be suitable for the overcoat composition based on the selected composition of the charge transport layer. The overcoat solution will usually comprise about 20 percent solids, 80 percent solute. However, the total solids content can be from about 1 to about 40 weight percent by weight of the solution. It should be noted that the amounts of the components above are given in terms of the dried overcoat layer because the solvent does not comprise any significant part of the finished overcoat layer.

The thickness of the overcoat layer may be selected as desired for a particular purpose or intended use. The thickness is selected in view of the desired electrical properties and the overcoat composition. If the overcoat layer is too thick, the background potential of the imaging member will increase. The upper limit of the thickness also depends on the polymer material used to form the overcoat layer and/or the molecular weight of the polymer material. The thickness of the dried overcoat layer may be from about 0.5 to about 10 μm. In other embodiments, the dried overcoat layer has a thickness of from about 1.0 to about 5 μm. In specific embodiments, the dried overcoat layer has a thickness of from about 2.0 to about 4 μm.

The overcoat solution can be prepared by any suitable conventional technique such as, for example, by mixing the solvent and the polymer material. The overcoat layer may be applied to the charge transport layer by any suitable application method. Non-limiting examples of suitable application methods include, for example, hand coating, spray coating, web coating, dip coating, and the like. Drying of the deposited coating can be effected by any suitable conventional technique such as, for example, oven drying, infrared radiation drying, air drying, and the like. The processing speed, drying temperature, and drying time are selected such that the overcoat layer has less than about 1% percent solvent remaining in the layer after drying.

After the overcoat solution has been applied, a crosslinked polymer matrix results which incorporates the crosslinking agent(s), hole transport molecule, and the POSS. The resulting overcoat layer is flexible to resist cracking, hard/tough to resist scratches, and imparts low surface energy to the imaging member. It also prevents cracks in lower layers from propagating to the top and causing print defects. Crosslinking adds mechanical strength to the siloxane-containing layer.

Aspects of the present disclosure are further understood with reference to the following examples. The examples are merely for further describing various aspects of an overcoat layer in accordance with the present disclosure and are not intended to be limiting embodiments thereof.

EXAMPLES

Example I

An imaging member was prepared by providing a 0.02 micrometer thick titanium layer coated on a biaxially oriented polyethylene naphthalate substrate (KALEDEX™ 2000) having a thickness of 3.5 mils. A blocking layer solution containing 50 grams of 3-amino-propyltriethoxysilane, 41.2 grams of water, 15 grams of acetic acid, 684.8 grams of denatured alcohol, and 200 grams of heptane was then applied. The solution was dried for about 5 minutes at 135° C. to make a blocking layer having a thickness of 500 Angstroms. An adhesive layer was then prepared by applying a wet coating containing 0.2 weight percent of the copolyester adhesive (ARDEL™ D100, available from Toyota Hsutsu Inc.) in a 60:30:10 volume ratio mixture of tetrahydrofuran/monochlorobenzene/methylene chloride. The adhesive layer was then dried for about 5 minutes at 135° C. to make an adhesive layer having a thickness of 200 Angstroms.

A photogenerating layer dispersion was prepared by introducing 0.45 grams of the known polycarbonate LUPILON™ 200 (PCZ-200) or Polycarbonate Z™, weight average molecular weight of 20,000, available from Mitsubishi Gas Chemical Corporation, and 50 milliliters of tetrahydrofuran into a 4 ounce glass bottle. To this solution was added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was left uncoated to allow for a ground strip layer that was applied later. The photogenerating layer was dried at 120° C. for 1 minute in a forced air oven to form a dry photogenerating layer having a thickness of 0.4 micrometer.

The resulting imaging member web was then overcoated with a two-layer charge transport layer. A solution was prepared by introducing into an amber glass bottle in a weight ratio of 1:1 N,N'-diphenyl-N,N'-bis(3-methylphenyl)-1,1'-biphenyl-4,4'-diamine, and Makrolon 5705®, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied using a 2 mil Bird bar, onto the photogenerating layer. Upon drying (135° C. for 5 minutes), a bottom charge transport layer was formed that had a thickness of 14.5 microns. During this coating process, the humidity was equal to or less than 15 percent. The solution then applied again to form a top charge transport layer. The resulting photoconductor device containing all of the above layers was annealed at 135° C. in a forced air oven for 5 minutes and thereafter cooled to ambient room temperature, about 23 to about 26 degrees Centigrade resulting in a thickness for each of the bottom and top charge transport layers of 14.5 microns.

The resulting photoreceptor had no overcoat layer.

Example II

An overcoat coating solution was formed by adding 10 parts of POLYCHEM® 7558-B-60 [from OPC Polymers), 4 parts of PPG 2K (polypropyleneglycol with a molecular weight of 2000 from Sigma-Aldrich), 6 parts of CYMEL® 1130 (methylated, butylated melamine-formaldehyde from Cytec Industries Inc.), 75 grams 1-methoxy-2-propanol, 8 parts of N,N'-diphenyl-N,N'-di[3-hydroxyphenyl]-1,1'-biphenyl-4,4'-diamine (DHTPD), 1.5 parts Silclean 3700 from BYK-Chemie USA and 5.5 parts of TSA solution [8% p-toluenesulfonic acid in 1-methoxy-2-propanol].

Example III

An overcoat coating solution was formed by adding 10 parts of POLYCHEM® 7558-B-60 [from OPC Polymers), 4 parts of PPG 2K (polypropyleneglycol with a molecular weight of 2000 from Sigma-Aldrich), 6 parts of CYMEL® 1130 (methylated, butylated melamine-formaldehyde from Cytec Industries Inc.), 1.5 grams trisilanol POSS 501458, 75 grams 1-methoxy-2-propanol, 8 parts of N,N'-diphenyl-N,N'-di[3-hydroxyphenyl]-1,1'-biphenyl-4,4'-diamine (DHTPD), 1.5 parts Silclean 3700 from BYK-Chemie USA and 5.5 parts of TSA solution [8% p-toluenesulfonic acid 1-methoxy-2-propanol].

Example IV

The photoconductor of Example I was overcoated with the above Example II overcoat solution using a ⅛ mil Bird bar. The resultant film was dried in a forced air oven for 2 minutes at 125° C. to yield a highly cross-linked, 3 micron overcoat and said overcoat was substantially insoluble in methanol or ethanol.

The resulting photoreceptor had an overcoat layer that did not contain silanol.

Example V

The photoconductor of Example I was overcoated with the above Example III overcoat solution using a ⅛ mil Bird bar. The resultant film was dried in a forced air oven for 2 minutes at 125° C. to yield a highly cross-linked, 3 micron overcoat and said overcoat was substantially insoluble in methanol or ethanol.

The resulting photoreceptor had an overcoat layer that contained silanol (more specifically, ph-POSS).

Electrical Testing

The photoreceptor belts of Examples I, IV, and V were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities are measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.). The devices were also cycled to 10,000 cycles electrically with charge-discharge-erase. Eight photoinduced discharge characteristic (PIDC) curves were generated, one for each of the above prepared photoconductors at both cycle=0 and cycle=10,000, and where V equals volt. The results are summarized in Table 1.

TABLE 1

| Exposure (ergs/cm$^2$) | Example I: No Overcoat Layer | Example IV: Overcoat without Silanol | Example V: Overcoat with POSS |
|---|---|---|---|
| 0.0 | 500 | 500 | 500 |
| 1.5 | 118 | 140 | 117 |

TABLE 1-continued

| Exposure (ergs/cm$^2$) | Example I: No Overcoat Layer | Example IV: Overcoat without Silanol | Example V: Overcoat with POSS |
|---|---|---|---|
| 2.6 | 80 | 102 | 78 |
| 3.5 | 72 | 94 | 70 |

Adding POSS to the overcoat significantly reduced the residual voltage compared to the overcoat without POSS. In fact, it was able to match the PIDC of the control belt.

Mechanical Testing

Samples of each belt were cut into strips of 1 inch width and 12 inches length and were flexed in a tri-roller flexing system. Each belt was under 1.1 lb/inch tension and each roller was ⅛ inches in diameter. A polyurethane "spots blade" was placed in contact with each belt at an angle between 5 and 15 degrees. Carrier beads of about 100 μm in size were attached to the spots blade with double-sided tape. The belts were flexed for 200 cycles. The surface morphology of each scratched area was then analyzed. Rq, the root mean square roughness, was chosen as the standard metric for scratch resistance assessment; a photoreceptor with excellent scratch resistance usually has an Rq of less than 0.1 μm. The control belt had an Rq of 0.23 μm, while the two belts with overcoats had an Rq of 0.06 to 0.08 μm. Adding POSS did not affect the scratch resistance of the overcoat.

Running LCM Test

Samples of each belt were cut into strips, then mounted on a drum to be scanned in a motionless electrical scanner. For each cycle, samples were charged to a potential of −500V, then discharged and erased. Samples were continuously charged and discharged for 10,000 cycles. During these cycles, the samples were also exposed to corona effluents. After 10,000 cycles, the samples were printed in a printer. The drum was printed with a target containing various types of bit lines for LCM deletion observation. The target print had 5 different bit lines ranging from 1 bit to 5 bit. The sample with the least number of visible lines was badly affected by corona effluents and electrical charging and concluded to be completely deleted if there were no visible lines. Adding POSS did not reduce the overcoat's ability to deter LCM.

Crack Resistance Test

Samples were cut into strips of 1 inch width and 12 inches length and were tested for mechanical crack resistance by being flexed on a tri-roller fixture with ¼ inch diameter rolls for 5,000 cycles. Cracks could be formed on the overcoat but not deep enough to be printable. The flexed areas were then exposed to corona effluent for 20 minutes to increase the size of the cracks, if any, into the overcoat. The flexed and exposed areas were then printed for crack assessment. Cracks, if any, appeared as black spots. Adding POSS did not reduce the overcoat's crack resistance.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An imaging member, comprising:

a substrate;

a charge transport layer; and an crosslinked overcoat layer formed from an overcoat solution comprising:

a silanol;

a first crosslinking agent a second crosslinking agent; and a hole transport molecule;

wherein covalent bonds are formed between the silanol, the first crosslinking agent, the second crosslinking agent, and the hole transport molecule.

2. The imaging member of claim 1, wherein the silanol is a polyhedral oligomeric polysilsesquioxane selected from one of the following formulas:

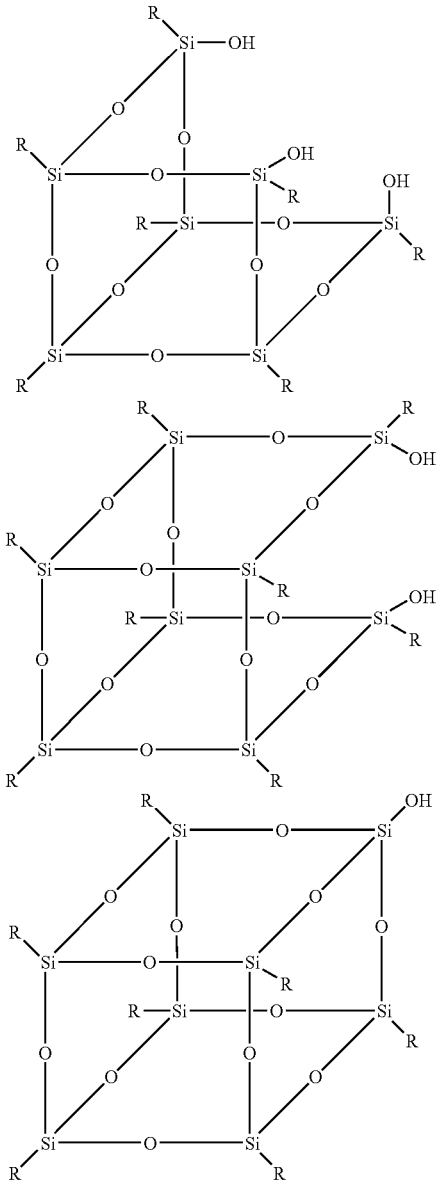

-continued

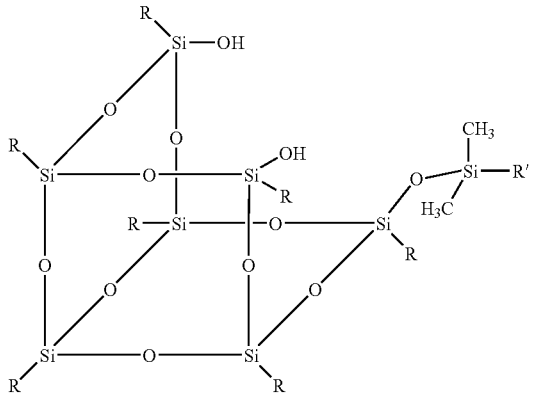

wherein R and R' are independently selected from alkyl, cycloalkyl, phenyl, aryl, alkoxy, or halogen.

3. The imaging member of claim 1, wherein the silanol is trisilanol phenyl polyhedral oligomeric polysilsesquioxane

4. The imaging member of claim 1, wherein the hole transport molecule is N,N'-diphenyl-N,N'-bis(3-hydroxyphenyl)-[1 ,1'-biphenyl]-4,4'-diamine (DHTPD).

5. The imaging member of claim 1, wherein the hole transport molecule is a terphenyl diamine of the following formula:

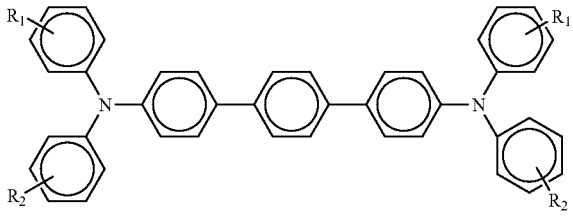

where $R_1$ and $R_2$ are independently selected from the group consisting of hydrogen, hydroxyl, alkyl having from 1 to about 12 carbon atoms, aralkyl having from about 6 to about 36 carbon atoms, and aryl having from about 6 to about 36 carbon atoms groups; wherein at least one of $R_1$ and $R_2$ is not hydrogen.

6. The imaging member of claim 1, wherein the hole transport molecule is present in an amount of from about 10 to about 60 weight percent, based on the weight of the dried overcoat layer.

7. The imaging member of claim 1, wherein the first and second crosslinking agents are selected from the group consisting of a polyhydroxy functional polymer, a hydroxyl containing material with three or more hydroxyl groups per molecule, a methylated and/or butylated melamine-formaldehyde resin, polycarbonates, polystyrenes, and polyamides.

8. The imaging member of claim 1, wherein the first crosslinking agent is a polyol or polyester having at least two hydroxyl or carboxyl crosslinking sites; and wherein the second crosslinking agent is a methylated and/or butylated melamine-formaldehyde resin.

9. The imaging member of claim 1, wherein the overcoat solution further comprises an acid catalyst selected from the group consisting of oxalic acid, maleic acid, carbollylic acid, ascorbic acid, malonic acid, succinic acid, tartaric acid, citric acid, p-toluenesulfonic acid, methanesulfonic acid, and mixtures thereof.

10. The imaging member of claim 1, wherein the overcoat solution has a pH of 3 or lower.

11. The imaging member of claim 1, wherein the overcoat solution further comprises a solvent which is a secondary or tertiary alcohol.

12. The imaging member of claim 11, wherein the alcohol is 1-methoxy-2-propanol.

13. The imaging member of claim 11, wherein the charge transport layer is not soluble in the solvent of the overcoat solution.

14. The imaging member of claim 1, wherein the overcoat solution further comprises an acid catalyst and an alcohol as solvent.

15. The imaging member of claim 1, wherein the dried overcoat has a thickness of from about 0.5 to about 10 μm.

16. An imaging member, comprising:

a substrate;

a charge transport layer; and a crosslinked overcoat layer, the layer comprising:

a trisilanol polyhedral oligomeric polysilsesquioxane (POSS) of the formula

Formula A

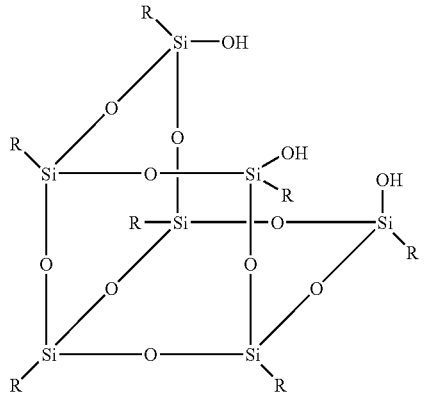

wherein R is alkyl, phenyl, aryl, alkoxy, hydroxyl, or halogen;

two crosslinking agents; and a hole transport molecule;

wherein covalent bonds are formed between the silanol, the two crosslinking agents, and the hole transport molecule.

17. The imaging member of claim 16, wherein the POSS is trisilanol phenyl polyhedral oligomeric polysilsesquioxane.

18. The imaging member of claim 16, wherein the hole transport molecule is N,N'-diphenyl-N,N'-bis(3-hydroxyphenyl)-[1,1'-biphenyl]-4,4'-diamine (DHTPD).

19. The imaging member of claim 16, wherein one crosslinking agent is a polyol or polyester having at least two hydroxyl or carboxyl crosslinking sites; and wherein the other crosslinking agent is a methylated and/or butylated melamine-formaldehyde resin.

20. An imaging member, comprising:

a substrate;

a charge transport layer; and a crosslinked overcoat layer formed from a solution comprising:

trisilanol phenyl polyhedral oligomeric polysilsesquioxane (POSS);

N,N'-diphenyl-N,N'-bis(3-hydroxyphenyl)-[1,1'-biphenyl]-4,4'-diamine (DHTPD);

a polyol or polyester having at least two hydroxyl or carboxyl crosslinking sites;

a methylated and/or butylated melamine-formaldehyde resin;

an acid catalyst; and an alcohol as solvent wherein covalent bonds are formed between the FOSS DHTPD polyol or polyester, and the melamine-formaldehyde resin.

* * * * *